US010128013B1

(12) United States Patent
Gunawan et al.

(10) Patent No.: US 10,128,013 B1
(45) Date of Patent: Nov. 13, 2018

(54) ELECTROMAGNETIC TRAP COOLING SYSTEM WITH PARALLEL DIPOLE LINE TRAP

(71) Applicant: International Business Machines Corporation, Armonk, NY (US)

(72) Inventors: Oki Gunawan, Westwood, NJ (US); Bruce G. Elmegreen, Golden Bridge, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/827,646

(22) Filed: Nov. 30, 2017

(51) Int. Cl.
*G21K 1/00* (2006.01)

(52) U.S. Cl.
CPC ..... *G21K 1/006* (2013.01)

(58) Field of Classification Search
USPC ..... 250/396 R, 251
See application file for complete search history.

(56) References Cited

U.S. PATENT DOCUMENTS

| | | | | |
|---|---|---|---|---|
| 6,025,769 | A | 2/2000 | Chu et al. | |
| 6,365,553 | B1 | 4/2002 | Tomita et al. | |
| 6,408,681 | B1 | 6/2002 | Gurton et al. | |
| 8,169,114 | B2 | 5/2012 | Simon | |
| 8,895,355 | B2 | 11/2014 | Cao et al. | |
| 9,093,377 | B2 | 7/2015 | Cao et al. | |
| 9,236,293 | B2 | 1/2016 | Cao et al. | |
| 9,263,669 | B2 | 2/2016 | Cao et al. | |
| 9,978,493 | B2 * | 5/2018 | Gunawan | H02N 15/00 |
| 2017/0299410 | A1 * | 10/2017 | Gunawan | G01D 5/24 |
| 2018/0031716 | A1 * | 2/2018 | Gunawan | G01V 1/008 |

FOREIGN PATENT DOCUMENTS

RU 2522666 C2 7/2014

OTHER PUBLICATIONS

Colchero et al., "Thermal frequency noise in dynamic scanning force microscopy", Journal of Applied Physics 109, 024310 (2011), Received Oct. 21, 2010; accepted Nov. 17, 2010; published online Jan. 21, 2011, © 2011 American Institute of Physics, 10 pages.

(Continued)

*Primary Examiner* — Kiet T Nguyen
(74) *Attorney, Agent, or Firm* — Monchai Chuaychoo

(57) ABSTRACT

A method, apparatus and system for decreasing random motions of a levitated diamagnetic cylinder is provided. Embodiments of the present invention utilizes a parallel dipole line (PDL) trap system to trap a diamagnetic object. The trap consists of a magnetic parallel dipole line system made of a pair of transversely magnetized (or diametric) cylindrical magnets. A diamagnetic object such as graphite rod can be trapped at the center. The system includes a differential photodetector pair, a differential amplifier, a differentiator, a proportional integral differential (PID) feedback controller and electrode voltage drive system. The feedback control system will minimize the speed of the trapped rod thus lowering its effective temperature. The system can be used to minimize intrinsic noise and enhance the precision in various sensing applications using a parallel dipole line trap.

20 Claims, 10 Drawing Sheets

(56) References Cited

OTHER PUBLICATIONS

Gunawan et al., "A parallel dipole line system", Applied Physics Letters 106, 062407 (2015), DOI: 10.1063/1.4907931, ResearchGate, (Received Nov. 20, 2014; accepted Jan. 23, 2015; published online Feb. 12, 2015), © 2015 AIP Publishing LLC. [http://dx.doi.org/10.1063/1.4907931], 0003-6951/2015/106 (6)/062407/5, 24 pages.

Jiao et al., "Research on Levitation Coupled with Standing Wave Levitation and Electromagnetic Levitation", Strojnlikl vestnlk—Journal al Mechanical Engineering 59(2013)12, 763-771 © 2013 Journal al Mechanical Engineering. All rights reserved, DOI: 10.5545/sv-jme.2013.1093, Original Scientific Paper, Received for review: Mar. 11, 2013, Received revised form: Jun. 13, 2013, Accepted for publication: 2013-0S.23, pp. 763-771.

Kippenberg et al., "Cavity Optomechanics: Back-Action at the Mesoscale", Aug. 29, 2008, vol. 321, Science 321 (5893), 1172-1176. [dol: 10.1126/Science 321 science.1156032], Downloaded from http://science.sciencemag.org/on Jun. 14, 2017, 6 pages.

Gunawan Oki, "Voltage-Tunable 1D Electro-Magnet Potential and Probe System With Parallel Dipole Line Trap", U.S. Appl. No. 15/131,443, filed Apr. 18, 2016, 32 pages.

Gunawan Oki, "Parallel Dipole Line Trap With Variable Gap and Tunable Trap Potential" U.S. Appl. No. 15/131,566, filed Apr. 18, 2016, 25 pages.

Gunawan et al., "A New Effect in Electromagnetism Discovered—150 years later", IBM Research, Oct. 20, 2017 Posted in: Physics, <https://www.ibm.com/blogs/research/2017/10/new-effect-electromagnetism/>, 7 pages.

* cited by examiner

Front View

Side View

Top View

Front View

Top View

Front View

Top View

Front View

Top View

Front View

Top View

ELECTROMAGNETIC TRAP COOLING SYSTEM WITH PARALLEL DIPOLE LINE TRAP

BACKGROUND OF THE INVENTION

The present invention relates generally to the field of electromagnetic trap systems and more particularly to trapping and cooling the trapped object using a parallel dipole line trap system.

Various kinds of electromagnetic trap systems are very important in physics. They allow isolation of particles or matter that enable many kinds of precision measurements and exploration of fundamental phenomena. Examples are the Penning trap, quadrupole ion trap, optical trap and magneto-optic-trap. The uses of these electromagnetic trap systems have broad applications for fundamental physics and technology. The Penning trap allows high precision measurement of fundamental parameters such as the electron gyromagnetic factor. The magneto-optic-trap (MOT) system allows trapping and cooling of atoms to remarkably low temperature. This system allows the creation of a new state of matter such as a Bose-Einstein condensate.

Active cooling systems similar to the cold atom system in a MOT can also be achieved for a macroscopic object. An example is the active cold-mirror system in the Laser Interferometer Gravitational-Wave Observatory (LIGO) experiment that allows precision interferometric measurements by lowering the vibration noise floor.

Therefore, realizing an active cooling system in an electromagnetic trap has a broad and fundamental interest in physics.

SUMMARY

According to an embodiment, a method for decreasing the motion of a levitated diamagnetic rod trapped between a pair of dipole line magnets, the method comprising: measuring a displacement signal of a diamagnetic rod based on a light source and one or more photodetectors; calculating a velocity signal and a drive polarity, based on the displacement signal, by a differentiator circuit wherein the velocity signal is sent to a proportional-integral-derivative (PID) control loop, wherein the PID control loop generates an output signal; responsive to a positive drive polarity, adjusting a first electrode based on the output signal; and responsive to a negative drive polarity, adjusting a second electrode based on the output signal.

According to another embodiment, an apparatus for decreasing random motions of a levitated diamagnetic cylinder, the apparatus comprising: a vacuum chamber; a plurality of dipole line magnets disposed within the vacuum chamber; a light source disposed within the vacuum chamber; one or more photodetectors disposed within the vacuum chamber; a diamagnetic rod disposed within the vacuum chamber; a second electrode and a first electrode disposed within the vacuum chamber and connected to an external power source; a control computer comprising a proportional-integral-derivative (PID) control loop; an input circuit connected to the one or more photodetectors, a differentiator circuit and inputs associated with the PID control loop; a differentiator circuit to calculate the velocity signal; and an output circuit connected to the first electrode, the second electrode and outputs associated with the PID control loop.

According to another embodiment, a system for decreasing random motions of a levitated diamagnetic cylinder, the system comprising: a vacuum chamber; a plurality of dipole line magnets disposed within the vacuum chamber; a light source disposed within the vacuum chamber; one or more photodetectors disposed within the vacuum chamber; a diamagnetic rod disposed within the vacuum chamber; a second electrode and a first electrode disposed within the vacuum chamber and connected to an external power source; a control computer comprising a proportional-integral-derivative (PID) control loop; an input circuit connected to the one or more photodetectors and inputs associated with the PID control loop; a differentiator circuit to calculate the velocity signal; an output circuit connected to the first electrode, the second electrode and outputs associated with the PID control loop; and a test server connected to the control computer over a network.

DETAILED DESCRIPTION

Figure 1:
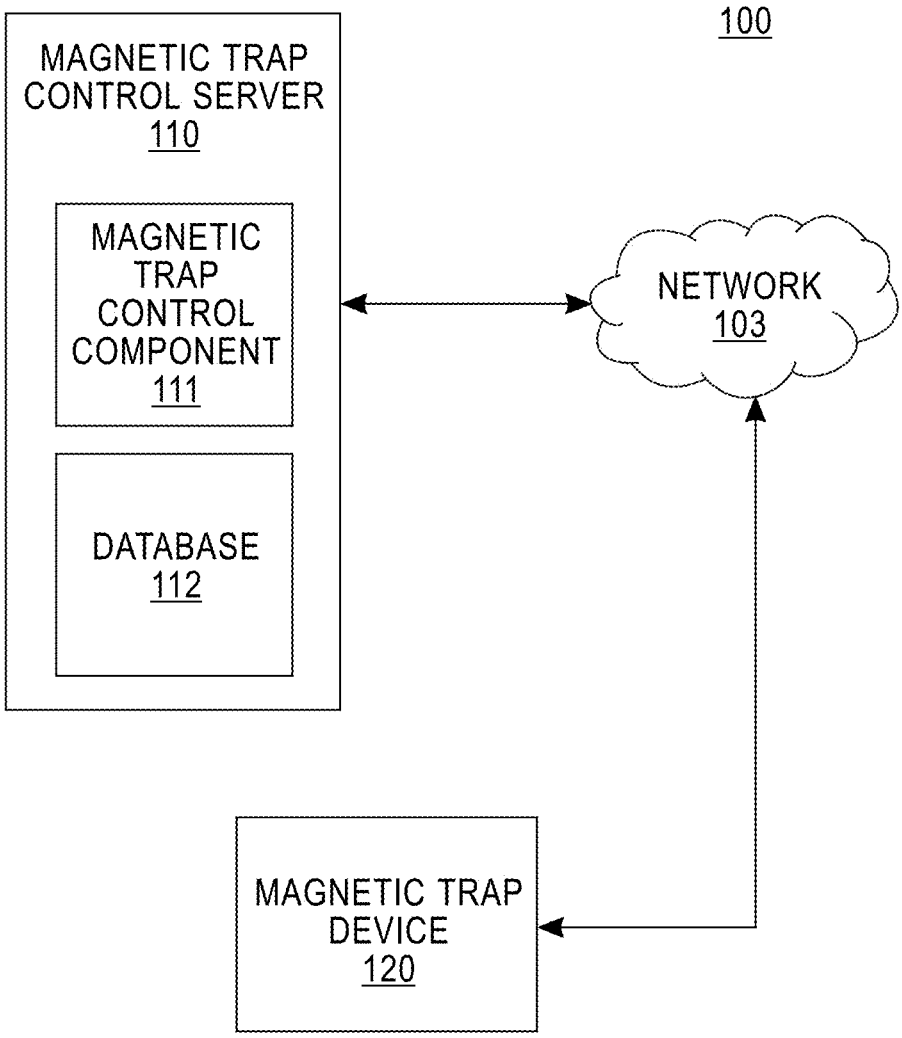
FIG. 1 is a functional block diagram illustrating the parallel dipole line (PDL) trap data processing environment 100, in accordance with an embodiment of the present invention.

Embodiments of the present invention recognize that improvements to precision measurements of existing magnetic traps or the creation of new states of matter can be made by using a parallel dipole line (PDL) trap system. A PDL trap system can trap a diamagnetic object. The trap consists of a magnetic parallel dipole line system made of a pair of transversely magnetized (or diametric) cylindrical magnets or dipole line magnets that naturally attract each other and align their magnetization. A diamagnetic cylindrical object such as graphite can be trapped at the center.

Detailed description of embodiments of the claimed structures and methods are disclosed herein; however, it is to be understood that the disclosed embodiments are merely illustrative of the claimed structures and methods that may be embodied in various forms. In addition, each of the examples given in connection with the various embodiments is intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the methods and structures of the present disclosure.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments, whether or not explicitly described.

The key discovery and the central feature of the PDL trap is the existence of a field confinement effect that forms a "camelback magnetic energy potential" along the longitudinal (z-axis); i.e. a magnetic field enhancement near the edge of the dipole line which occurs when the length of the system is larger than a critical length, i.e. $L>L_C$, where, in an experimental context using the diametric magnet system, $L_C$~2.5 a where a is the radius of the magnet. This camelback potential effect is a natural effect of electromagnetism found in a system of two lines of transverse dipoles whose length is beyond the critical length. (See Gunawan et al., "The one-dimensional camelback potential in the parallel dipole line trap: Stability conditions and finite size effect", J. Appl. Phys. 121, 133902 (2017)).

By adding a pair of drive electrodes around the trapped object one could manipulate the position of the trapped object. This makes the PDL trap serve as a functional electromagnetic trap device where one could trap, drive and detect the trapped object in the trap.

In a mechanical oscillator, the vibration amplitude is given as $$z_n = \sqrt{\frac{4k_B T}{Qm\omega_0^3}} \tag{1}$$

here $k_B$ is the Boltzmann constant, Q is the quality factor, m is the mass of the object and w is the angular frequency of the oscillator and T is the temperature. For example, a PDL trap could have system parameters: rod radius b=0.65 mm, length l=10 mm, density ρ=1750 kg/m$^3$, camelback oscillation frequency f=0.64 Hz, and oscillator quality factor Q=15,000 (in vacuum) at room temperature T=298 K. Then we have: $z_n$=27 pm/Hz$^{0.5}$. The phonon populations in the system can be calculated as:

$$N = \frac{k_z \bar{z}_n^2}{2\hbar\omega_0} = \frac{m\omega_0 \bar{z}_n^2}{2\hbar}, \text{ where } \bar{z}_n^2 = z_n^2 f_{BW} \tag{2}$$

Assuming an operation bandwidth $f_{BW}$~1 Hz in the system (quenching all sidebands), then the starting phonon population (before cooling is activated) is approximately: N~3.2×10$^8$. This phonon population N is proportional to $z_n^2$ and to the "effective" temperature T. Therefore, by activating the electromagnetic cooling system, the vibration amplitude can be quenched and the effective temperature, T, is reduced.

The present embodiment also utilizes a PDL trap system with a graphite rod as the trapped object. The system is equipped with a pair of electrodes (see FIG. 2A), differential photodetectors and a feedback loop electronic circuit using a proportional-differential-integral (PID) system. The differential photodetectors detect the displacement of the rod and the signal is fed to the differential amplifier, a differentiator and PID feedback controller and electrode voltage drive the electrodes to counteract the movement of the rod. As a result, smaller vibrations are obtained. Thus the present embodiment describes a system to decrease the physical motions of a trapped object. Since the effective rod temperature is proportional to the square of the vibration amplitude, the object effective temperature is lowered, even if the surrounding ambient temperature is not.

This cooling effect is important as it allows a lower displacement noise floor ($z_N$) that will benefit many applications using PDL traps such as seismometer, inclinometer and gravimeter allowing them to measure a smaller range of signals or achieving better measurement accuracy.

FIG. 1 is a functional block diagram illustrating a PDL trap data processing environment, generally designated 100, in accordance with one embodiment of the present invention. FIG. 1 provides only an illustration of one implementation and does not imply any limitations with regard to the environments in which different embodiments may be implemented. Many modifications to the depicted environment may be made by those skilled in the art without departing from the scope of the invention as recited by the claims.

PDL trap data processing environment 100 includes magnetic trap control server 110 and magnetic trap device 120, all interconnected over network 103. Network 103 can be, for example, a telecommunications network, a local area network (LAN), a wide area network (WAN), such as the Internet, or a combination of the three, and can include wired, wireless, or fiber optic connections. Network 103 can include one or more wired and/or wireless networks that are capable of receiving and transmitting data, voice, and/or video signals, including multimedia signals that include voice, data, and video information. In general, network 103 can be any combination of connections and protocols that will support communications between magnetic trap control server 110, magnetic trap device 120, and other computing devices (not shown) within PDL trap data processing environment 100.

Magnetic trap control server 110 can be a standalone computing device, a management server, a web server, a mobile computing device, or any other electronic device or computing system capable of receiving, sending, and processing data. In other embodiments, magnetic trap control server 110 can represent a server computing system utilizing multiple computers as a server system, such as in a cloud computing environment. In another embodiment, magnetic trap control server 110 can be a laptop computer, a tablet computer, a netbook computer, a personal computer (PC), a desktop computer, a personal digital assistant (PDA), a smart phone, or any other programmable electronic device capable of communicating with magnetic trap device 120, and other computing devices (not shown) within PDL trap data processing environment 100 via network 103. In another embodiment, magnetic trap control server 110 represents a computing system utilizing clustered computers and components (e.g., database server computers, application server computers, etc.) that act as a single pool of seamless resources when accessed within PDL trap data processing environment 100. Magnetic trap control server 110 includes magnetic trap control component 111 and database 112.

Magnetic trap control component 111 enables the present invention to control magnetic trap device 120. In the depicted embodiment, magnetic trap control component 111 resides on magnetic trap control server 110. In another embodiment, magnetic trap control component 111 can reside on magnetic trap device 120.

Database 112 is a repository for data used by magnetic trap control system 111. In the depicted embodiment, database 112 resides on magnetic trap control server 110. In another embodiment, database 112 may reside elsewhere within PDL trap data processing environment 100, provided that magnetic trap control system 111 has access to database 112. A database is an organized collection of data. Database 112 can be implemented with any type of storage device capable of storing data and configuration files that can be accessed and utilized by magnetic trap control server 110, such as a database server, a hard disk drive, or a flash memory. Database 112 uses one or more of a plurality of techniques known in the art to store a plurality of information regarding experimentation runs. For example, database 112 may store information about measurements from various cycle runs of the trap.

Magnetic trap device 120 enables the present invention to measure and cool the trapped object. In the depicted embodiment, magnetic trap device 120 consists of several components (refer to FIG. 2) that work in tandem to conduct various experiments to measure and cool trapped objects such as diamagnetic rods.

Figure 2A:
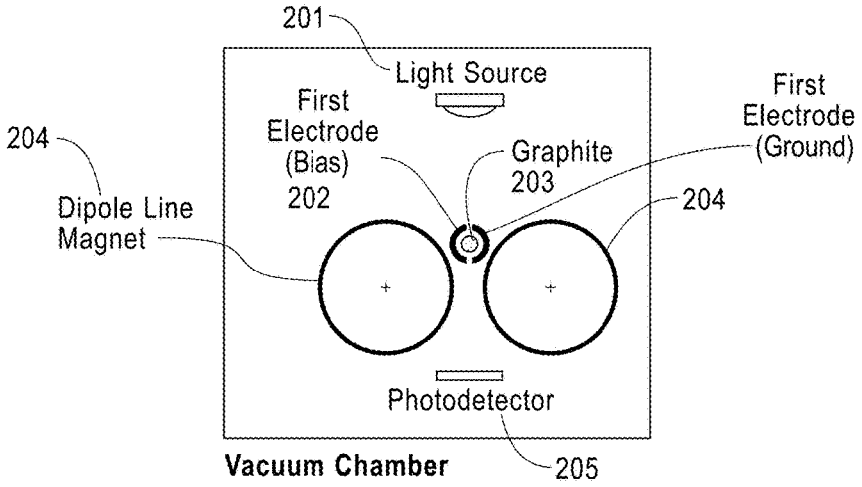
FIG. 2A is a diagram depicting a front view of PDL trap and the electronics control system in accordance with an embodiment of the present invention.
Figure 2B:
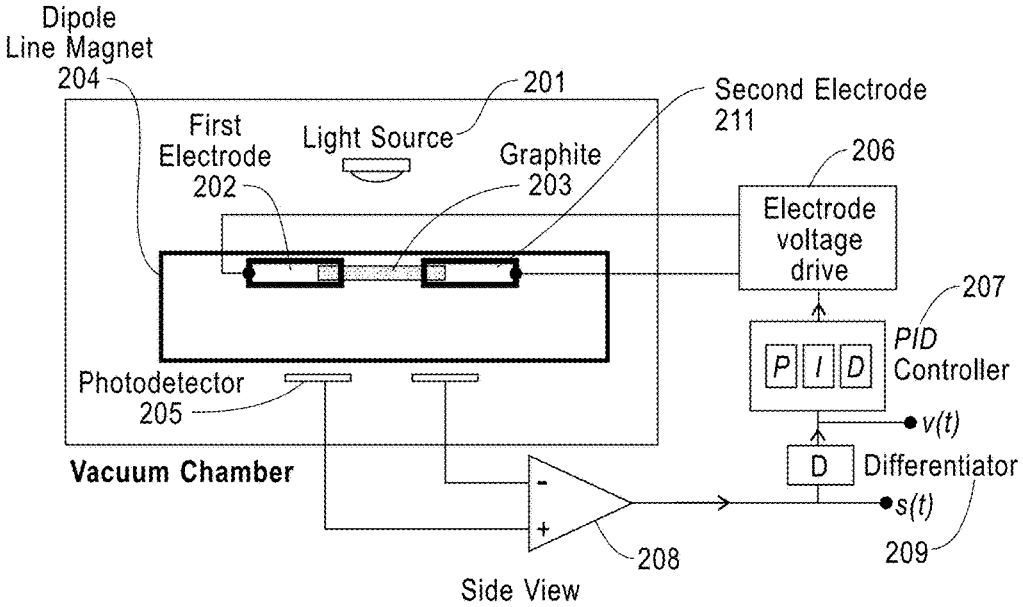
FIG. 2B is a diagram depicting a side view of PDL trap and the electronics control system in accordance with an embodiment of the present invention.
Figure 2C:
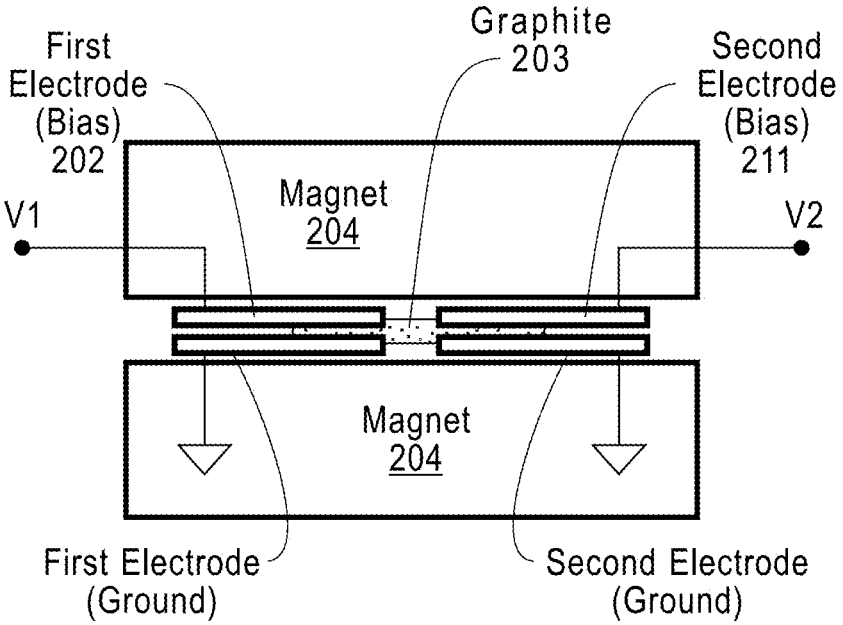
FIG. 2C is a diagram depicting a top view of PDL trap and the electronics control system in accordance with an embodiment of the present invention.

FIGS. 2A, 2B and 2C are diagrams depicting a front view, a side view and top view, respectively, of the magnetic trap device 120. The magnetic trap device comprises of light source 201, a first and second electrodes (ground) on the left and first and second electrodes (bias) on the right in FIG. 2A, one or more first electrodes 202 and one or more second electrodes 211 in FIG. 2B. Also there is diamagnetic rod 203, pair of dipole line magnets 204, a differential photodetector pair 205, differential amplifier 208, differentiator 209, proportional-integral-derivative (PID) controller 207 and electrode voltage drive 206.

Light source 201 of the present invention provides the capability to use light as a source of illumination. In an embodiment, light source 201 provides the mechanism to measure the position and motion of a trapped object such as a graphite rod. The light source could be broadband or monochromatic from infrared to ultraviolet (UV) such as a light emitting diode. To minimize the diffraction limit the preferred wavelength of the light source is a short wavelength such as those found in ultraviolet (UV), provided the light source does not damage or ionize the trapped object.

First electrode 202 and second electrode 211 of the present invention provide the capability to drive the motion of the graphite rod. There are two distinct electrodes that are located on the opposite ends, along the longitudinal axis, of the diamagnetic rod 203. For the purposes of the description hereinafter, the term "left" electrode and "right" electrode shall relate to the disclosed structures and method, as oriented in the drawing figures. "Left" electrode shall be synonymous with the term, first electrode 202. "Right" electrode shall be synonymous with the term, second electrode 211.

Referring to FIG. 2C, top view, on the arrangement of the two electrodes, first electrode 202 has two connections, one for the bias (V1) and one for ground. Second electrode 211 has two connections, one for the bias (V2) and one for ground as denoted in FIG. 2C. It is noted throughout this disclosure that both electrodes will contain at least one connection for the bias (V1,V2) and one for the ground. It is further noted that the ground for the two electrodes may be tied to the ground of dipole line magnet 204.

Figure 4A:
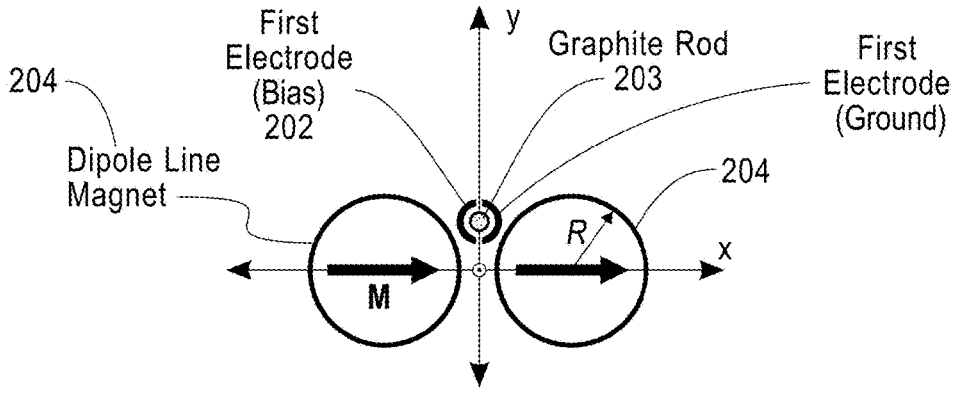
FIG. 4A depicts (front view) one embodiment, the "enclosing electrodes" design, of the plurality of electrodes enclosure configuration, in accordance with the present invention.
Figure 4B:
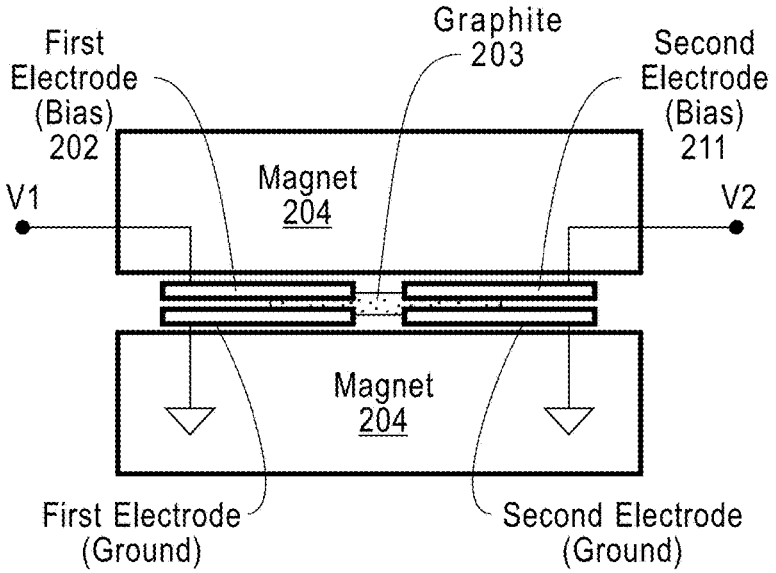
FIG. 4B depicts (top view) one embodiment, the "enclosing electrodes" design, of the plurality of electrodes enclosure configuration, in accordance with the present invention.

In an embodiment, first and second electrodes (ground) and first and second electrodes (bias, 202 and 211) are arranged in an "enclosing electrode" configuration (see FIGS. 4A and 4B). The advantage of the "enclosing electrode" configuration is that it has a high capacitance due to close proximity between the two capacitor plates and hence, a low voltage operation. However, due to the physical structure design, this configuration is more difficult to fabricate and miniaturize.

In another embodiment, first and second electrodes 202 and 211 and ground electrodes are arranged in an "open" electrode configuration (see FIGS. 5A and 5B, 5C and 5D, 5E and 5F). There are three types of "open" electrode designs, Types I, II, and III. These three types have a common advantage of being easier to fabricate than the enclosing electrode configuration.

In another embodiment (referring to FIGS. 5A and 5B), Type I has non-magnetic metallic foils partially wrapped around the magnets with an insulating layer in between. Type I has a disadvantage compared to the enclosing electrode configuration of having a lower capacitance and hence, a higher voltage operation. In addition, the field lines are going from the first electrode 202 or the second electrode 211 to ground, transverse to the rod, which induces a sideways torsional motion to the diamagnetic rod. An interesting feature of Type II is that the left and right drive electrodes have a common ground.

In yet another embodiment (referring to FIGS. 5C and 5D), Type II has non-magnetic metallic foils partially wrapped around the magnet with an insulating layer, insulator 210, in between the foils and magnet. Type II has a disadvantage compared to the enclosing electrode configuration of having a lower capacitance and hence, a higher voltage operation. An interesting feature of Type II is that the left and right drive electrodes have no common ground. The magnets are grounded together. In addition to being easier to fabricate, Type II has minimal effects from sideways torsional motions because the field lines go symmetrically from the first electrode pair to the neighboring ground or from the second electrode pair to the neighboring ground, or between the electrodes if the two electrodes have different voltages.

In yet another embodiment (referring to FIGS. 5E and 5F), Type III has overhanging electrodes parallel and displaced from the diamagnetic rod. Type III has a disadvantage compared to the enclosing electrode configuration of having a slightly lower capacitance and hence, a slightly higher voltage operation. The magnet serves as a common ground. In addition to being easier to fabricate, Type III has minimal effects from sideways torsional motions because the field lines go from the electrodes to the magnet or between the electrodes if the two electrodes have different voltages.

Diamagnetic rod 203 of the present invention is used as the trapped object. In an embodiment, diamagnetic rod 203 is made from a material with a high ratio of magnetic susceptibility to mass density, such as graphite.

The pair of dipole line magnets 204 of the present invention provides the magnetic field to levitate and trap a diamagnetic object. In an embodiment, dipole line magnets 204 are made from transversely magnetized (or diametric) cylinder magnets. It is noted that the orientation of the magnets' magnetization is transverse (perpendicular) to the axes of the magnetic cylinders as shown in FIG. 2A.

A pair of differential photodetectors 205 of the present invention provides the capability for sensing the rod displacement. In an embodiment, a pair of differential photodetectors 205 is used to receive light from light source 201 as the light passes around the diamagnetic rod 203. It is noted that the use of a lens is permissible since the lens can collimate the light source towards the pair of differential photodetectors 205.

Electrode voltage drive 206 of the present invention provides the capability to apply the drive voltage to the first electrode 202 and second electrode 211. In an embodiment, electrode voltage drive 206 processes incoming signals from differential photodetector 205 and PID controller 207. Electrode voltage drive 206 will produce the voltage that drives both first electrode 202 and second electrode 211.

PID controller 207 of the present invention provides the capability to process the velocity signal produced by the differentiator 209. The In an embodiment, PID controller 207 processes the velocity signal denoted by v(t). PID controller 207 can be tuned with at least three parameters, the proportional, integral, and differential gain settings. It is noted that the displacement signal, s(t) and the velocity signal, v(t), are non-transitory signals and are not to be construed as transitory signals.

Differential amplifier 208 of the present invention provides the capability to process and amplify the signal from a pair of differential photodetectors 205. In an embodiment, differential amplifier 208 processes the photocurrent difference between the photodetector elements and amplifies it to produce a displacement signal, s(t), to be used by differentiator 209 and PID controller 207 to control both first electrode 202 and second electrode 211.

Differentiator 209 of the present invention provides the capability to create a velocity signal based on output from differential amplifier 208. Differentiator 209 can be implemented by a standard circuit using a single operational-amplifier (op-amp) and a resistor-capacitor (RC) feedback network.

In an embodiment, both differentiator 209 and PID controller 207 work in tandem to optimally minimize the motion of diamagnetic rod 203.

Figure 3:
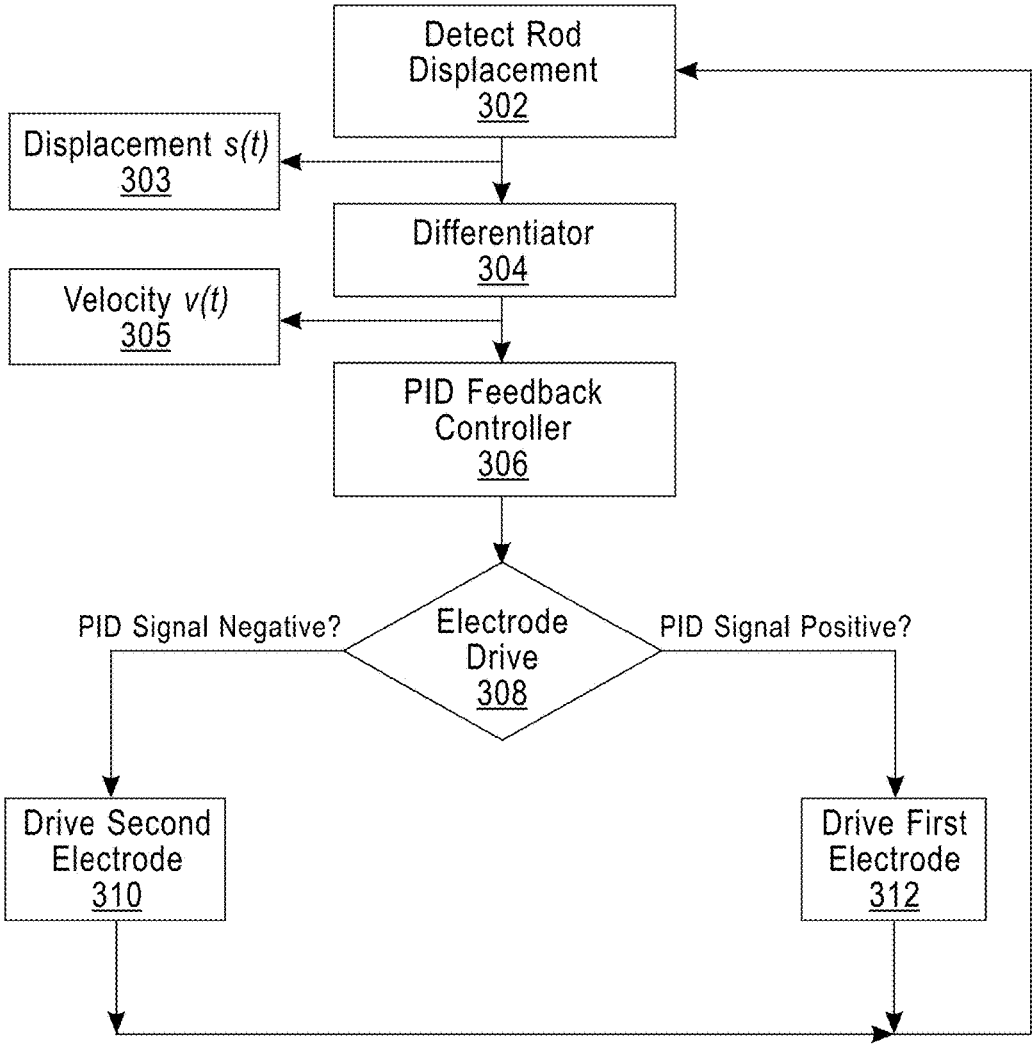
FIG. 3 is a flowchart depicting operational steps of a method for the parallel dipole line trap, in accordance with an embodiment of the present invention.

FIG. 3 is a flowchart depicting the operational steps of the magnetic trap control component 111, within data processing environment 100 of FIG. 1, in accordance with an embodiment of the present invention.

Differential photodetectors 205 detect the diamagnetic rod 203 displacement (step 302). In an embodiment, light source 201 transmits a light around diamagnetic rod 203 towards a pair of photodetectors that forms a differential photodetector setup 205. The difference in the light flux detected by the two photodetectors is proportional to the displacement of the cylindrical rod. The displacement signal, s(t), is amplified by differential amplifier 208 (step 303). It is noted that users may wish to monitor the displacement signal separately since PID loop controller manages the movement based on the displacement and velocity signal.

Differentiator 209 receives the displacement signal (step 304). The displacement signal is differentiated by differentiator 209 to produce the velocity signal, v(t), (step 305).

PID controller 207 processes the velocity signal (from step 305) and produces an output signal to the electrode voltage drive 206. In an embodiment, the detected signal, s(t), is amplified by differential amplifier 208, and the signal is fed to the differentiator 209, PID controller 207 and eventually to electrode voltage drive 206. The PID controller 207 feedback system processes any deviation in the velocity signal, v(t), of the diamagnetic rod. It is noted that users may wish to monitor the velocity signal separately since PID loop controller manages the movement based on the displacement and velocity signal.

Electrode voltage drive 206 determines which direction to adjust or drive the electrodes (decision block 308). Diamagnetic rod 203 is adjusted based on the polarity of the signal. In an embodiment, electrode voltage drive 206 will process the velocity signal v(t), to apply bias drive voltage to either the first electrode 202 or second electrode 211. The first electrode 202 will pull the diamagnetic rod 203 towards it when energized. The second electrode 202 will pull the diamagnetic rod 203 towards it when energized.

Electrode voltage drive 206 adjusts first electrode 202 (step 310). If the diamagnetic rod is moving to the right (positive velocity) then the electrode voltage drive 206 will energize the first electrode with a bias voltage to pull the diamagnetic rod 203 towards the left (negative direction).

Electrode voltage drive 206 adjusts second electrode 211 (step 312). If the diamagnetic rod is moving to the left (negative velocity) then electrode voltage to drive 206 will energize the second electrode with a bias voltage to pull diamagnetic rod 203 towards the right (positive displacement).

Furthermore, PID controller 207 continuously monitors the velocity signal v(t), generated by the system. Based on the velocity signals, PID controller 207 may adjust diamagnetic rod 203 to reach a steady state position or zero velocity. Consequently, if diamagnetic rod 203 reaches a steady state position, then the system reaches the base effective temperature.

FIG. 4A depicts (front view) one embodiment, the "enclosing electrodes", of first electrode (ground) and first electrode (bias) 202 enclosure configuration, in accordance with an embodiment of the present invention.

FIG. 4B depicts (top view) one embodiment, the "enclosing electrodes", of first electrode 202 and second electrode 211 enclosure configuration, in accordance with an embodiment of the present invention.

Figure 5A:
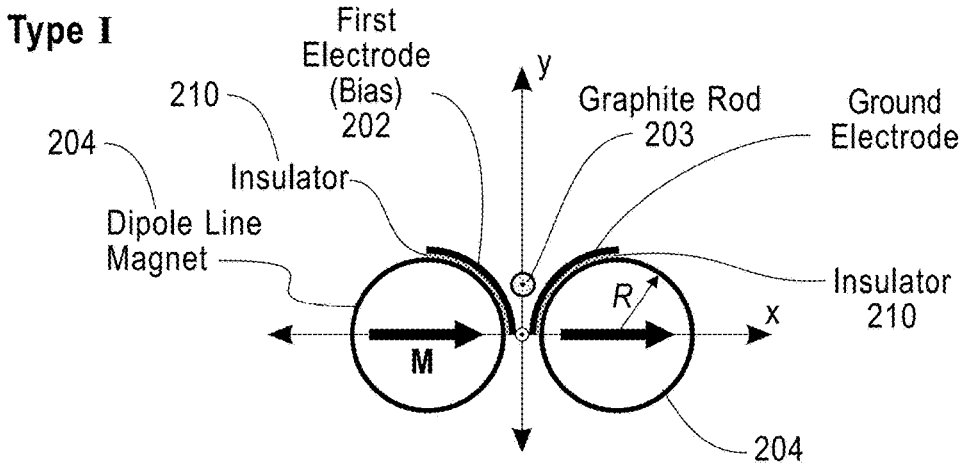
FIG. 5A depicts (front view) another embodiment, the "non-enclosing electrodes" (TYPE I) design, of the plurality of electrodes enclosure configuration, in accordance with the present invention.

FIG. 5A depicts (front view) another embodiment, the "non-enclosing electrodes" (TYPE I), of ground electrode and first electrode (bias) 202 non-enclosing configuration, in accordance with an embodiment of the present invention.

Figure 5B:
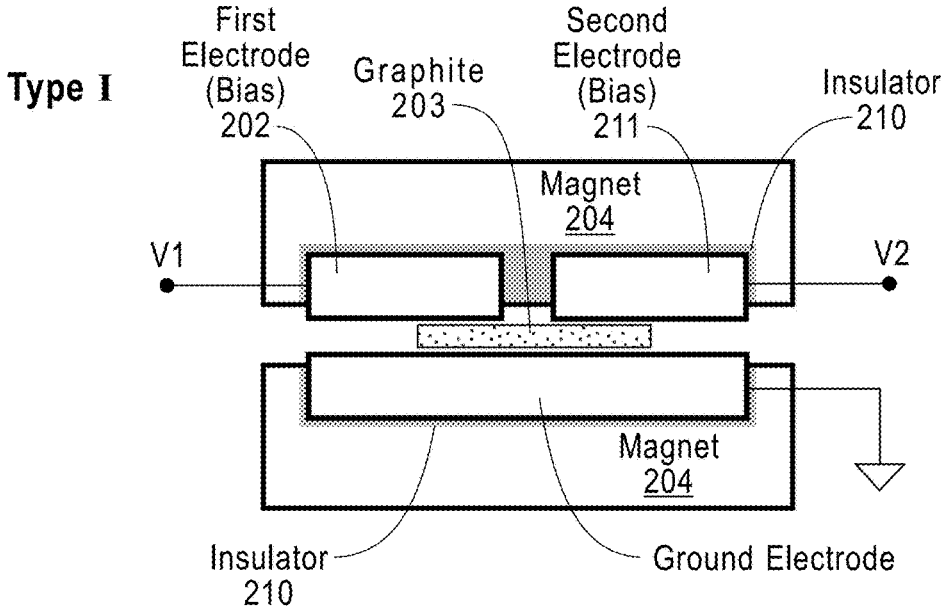
FIG. 5B depicts (top view) another embodiment, the "non-enclosing electrodes" (TYPE I) design, of the plurality of electrodes enclosure configuration, in accordance with the present invention.

FIG. 5B depicts (top view) another embodiment, the "non-enclosing electrodes" (TYPE I), of first electrode 202 and second electrode 211 non-enclosing configuration, in accordance with an embodiment of the present invention.

Figure 5C:
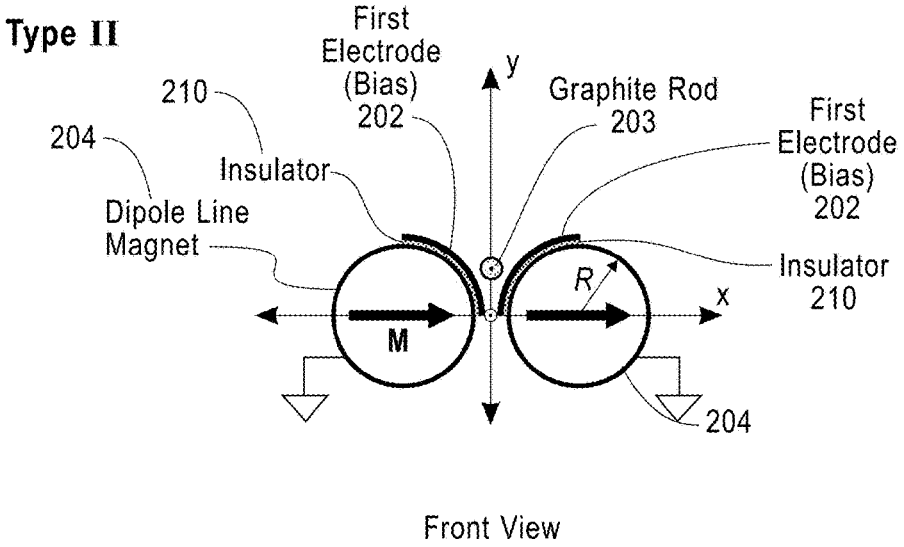
FIG. 5C depicts (front view) another embodiment, the "non-enclosing electrodes" (TYPE II) design, of the plurality of electrodes enclosure configuration, in accordance with the present invention.

FIG. 5C depicts (front view) another embodiment, the "non-enclosing electrodes" (TYPE II), of first electrode (bias) 202 non-enclosing configuration, in accordance with an embodiment of the present invention.

Figure 5D:
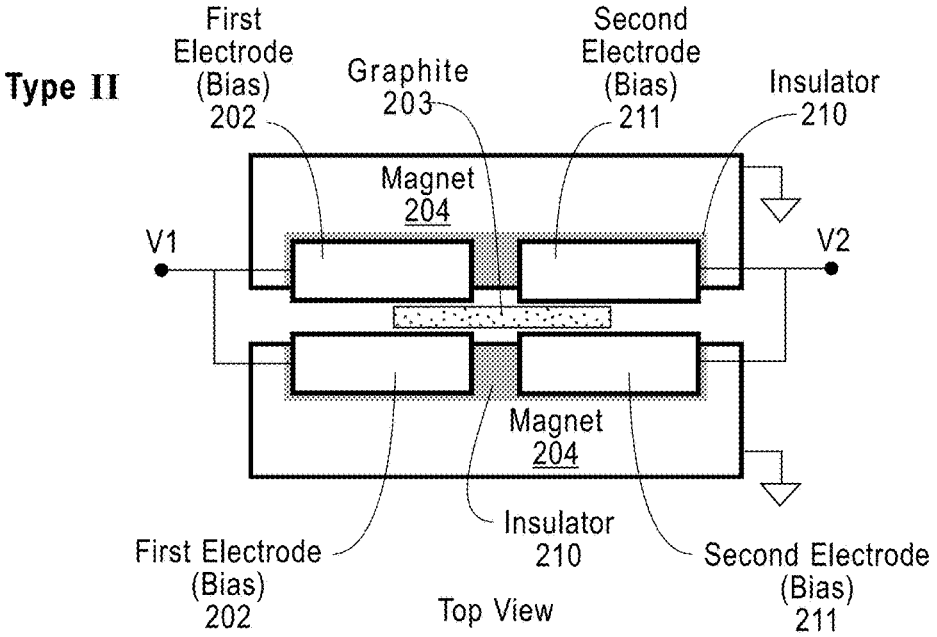
FIG. 5D depicts (top view) another embodiment, the "non-enclosing electrodes" (TYPE II) design, of the plurality of electrodes enclosure configuration, in accordance with the present invention.

FIG. 5D depicts (top view) another embodiment, the "non-enclosing electrodes" (TYPE II), of first electrode 202 second electrode 211 non-enclosing configuration, in accordance with an embodiment of the present invention.

Figure 5E:
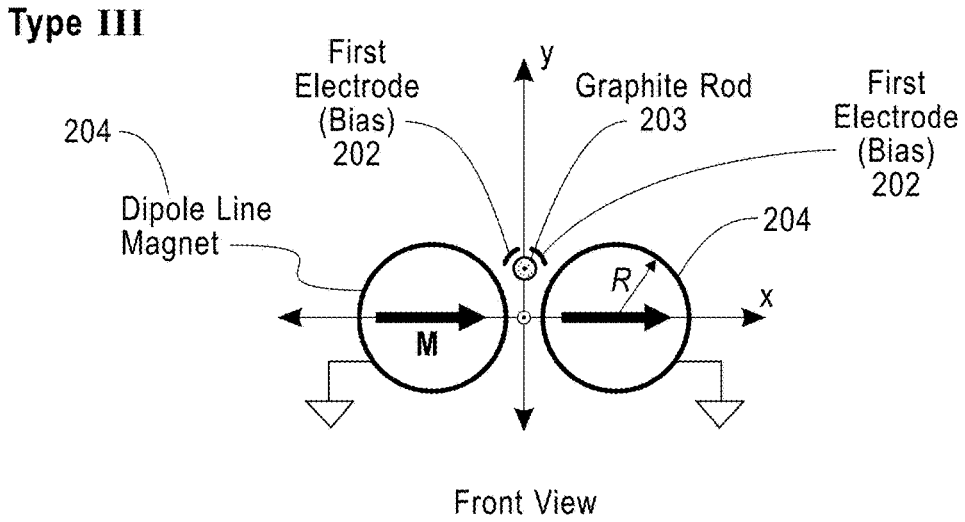
FIG. 5E depicts (front view) another embodiment, the "non-enclosing electrodes" (TYPE III) design, of the plurality of electrodes enclosure configuration, in accordance with the present invention.

FIG. 5E depicts (front view) another embodiment, the "non-enclosing electrodes" (TYPE III), of first electrode (bias) 202 non-enclosing configuration, in accordance with an embodiment of the present invention.

Figure 5F:
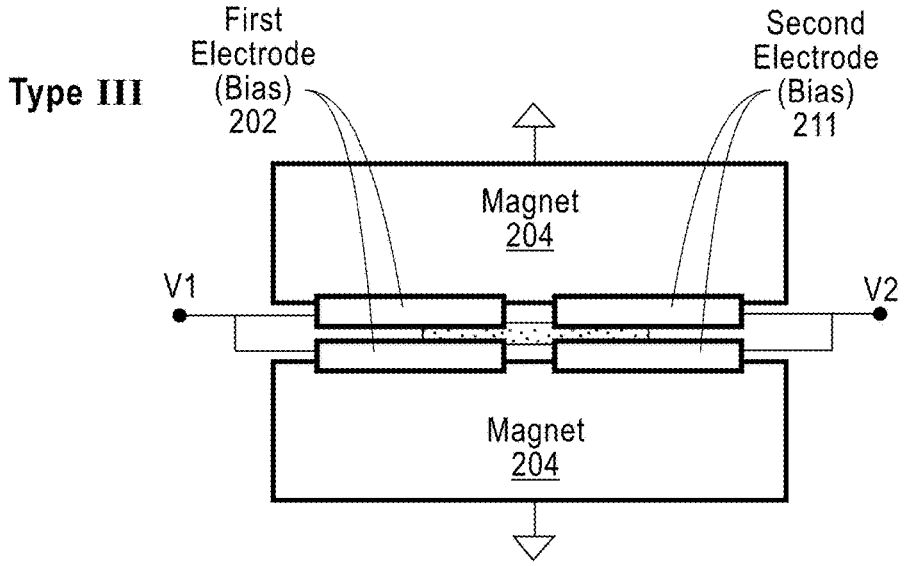
FIG. 5F depicts (top view) another embodiment, the "non-enclosing electrodes" (TYPE III) design, of the plurality of electrodes enclosure configuration, in accordance with the present invention.

FIG. 5F depicts (top view) another embodiment, the "non-enclosing electrodes" (TYPE III), of first electrode 202 and second electrode 211 non-enclosing configuration, in accordance with an embodiment of the present invention.

Figure 6:
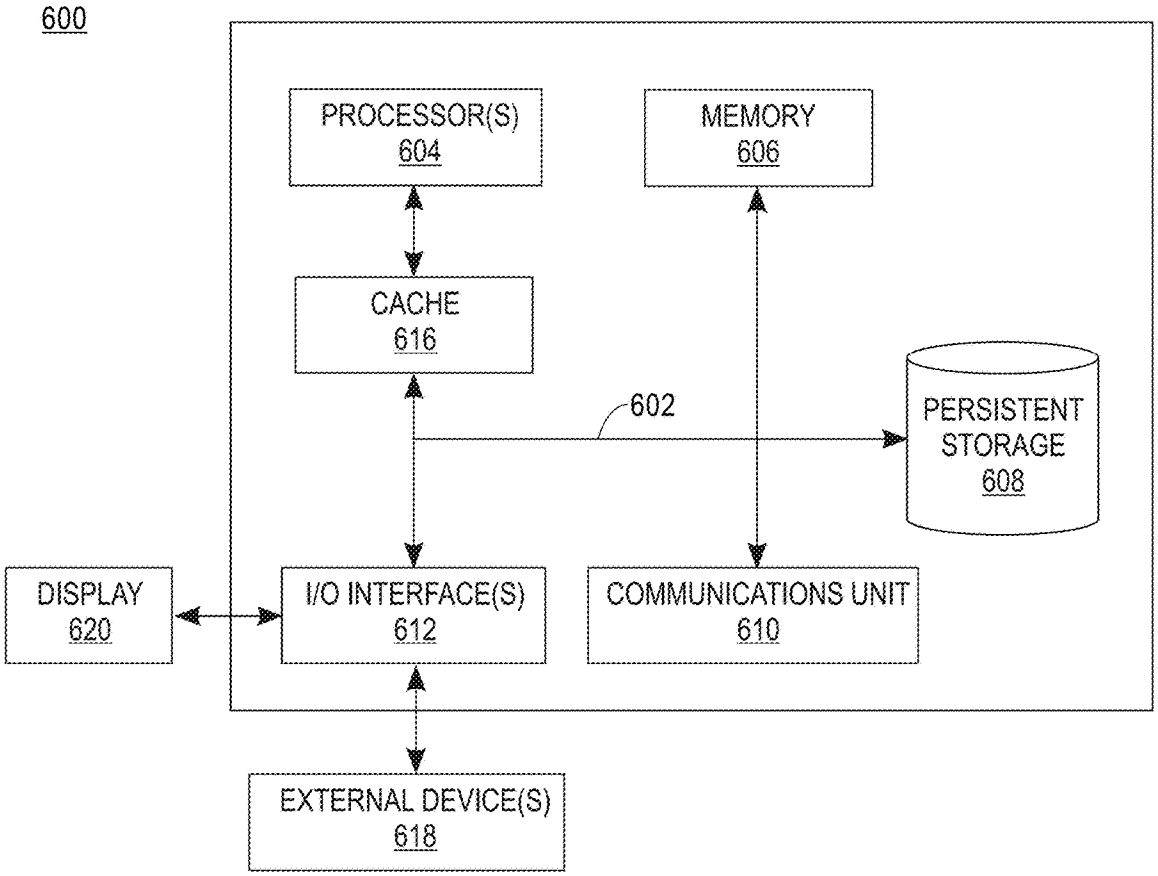
FIG. 6 depicts a block diagram, designated as 600, of components of the server computer executing the program within the PDL trap data processing environment of FIG. 1, in accordance with an embodiment of the present invention.

FIG. 6 depicts a block diagram of components of the magnetic trap control server 110, designated as 600, in accordance with an embodiment of the present invention. It should be appreciated that FIG. 6 provides only an illustration of one implementation and does not imply any limitations with regard to the environments in which different embodiments can be implemented. Many modifications to the depicted environment can be made.

Magnetic trap control server 110 can include processor(s) 604, cache 616, memory 606, persistent storage 608, communications unit 610, input/output (I/O) interface(s) 612 and communications fabric 602. Communications fabric 602 provides communications between cache 616, memory 606, persistent storage 608, communications unit 610, and input/output (I/O) interface(s) 612. Communications fabric 602 can be implemented with any architecture designed for passing data and/or control information between processors (such as microprocessors, communications and network processors, etc.), system memory, peripheral devices, and any other hardware components within a system. For example, communications fabric 602 can be implemented with one or more buses.

Memory 606 and persistent storage 608 are computer readable storage media. In this embodiment, memory 606 includes random access memory (RAM). In general, memory 606 can include any suitable volatile or non-volatile computer readable storage media. Cache 616 is a fast memory that enhances the performance of processor(s) 604 by holding recently accessed data, and data near recently accessed data, from memory 606.

Program instructions and data used to practice embodiments of the present invention, e.g., magnetic trap control component 111 and database 112, can be stored in persistent storage 608 for execution and/or access by one or more of the respective processor(s) 604 of magnetic trap control server 110 via memory 606. In this embodiment, persistent storage 608 includes a magnetic hard disk drive. Alternatively, or in addition to a magnetic hard disk drive, persistent storage 608 can include a solid-state hard drive, a semiconductor storage device, a read-only memory (ROM), an erasable programmable read-only memory (EPROM), a flash memory, or any other computer readable storage media that is capable of storing program instructions or digital information.

The media used by persistent storage 608 may also be removable. For example, a removable hard drive may be used for persistent storage 608. Other examples include optical and magnetic disks, thumb drives, and smart cards that are inserted into a drive for transfer onto another computer readable storage medium that is also part of persistent storage 608.

Communications unit 610, in these examples, provides for communications with other data processing systems or devices, including resources of client computing device 120. In these examples, communications unit 610 includes one or more network interface cards. Communications unit 610 may provide communications through the use of either or both physical and wireless communications links. Magnetic trap control component 111 and database 112 may be downloaded to persistent storage 608 of magnetic trap control server 110 through communications unit 610.

I/O interface(s) 612 allows for input and output of data with other devices that may be connected to magnetic trap control server 110. For example, I/O interface(s) 612 may provide a connection to external device(s) 618 such as a keyboard, a keypad, a touch screen, a microphone, a digital camera, and/or some other suitable input device. External device(s) 618 can also include portable computer readable storage media such as, for example, thumb drives, portable optical or magnetic disks, and memory cards. Software and data used to practice embodiments of the present invention, e.g., magnetic trap control component 111 and database 112 on magnetic trap control server 110, can be stored on such portable computer readable storage media and can be loaded onto persistent storage 608 via I/O interface(s) 612. I/O interface(s) 612 also connect to a display 620.

Display 620 provides a mechanism to display data to a user and may be, for example, a computer monitor or the lenses of a head mounted display. Display 620 can also function as a touchscreen, such as a display of a tablet computer.

Figure 7:
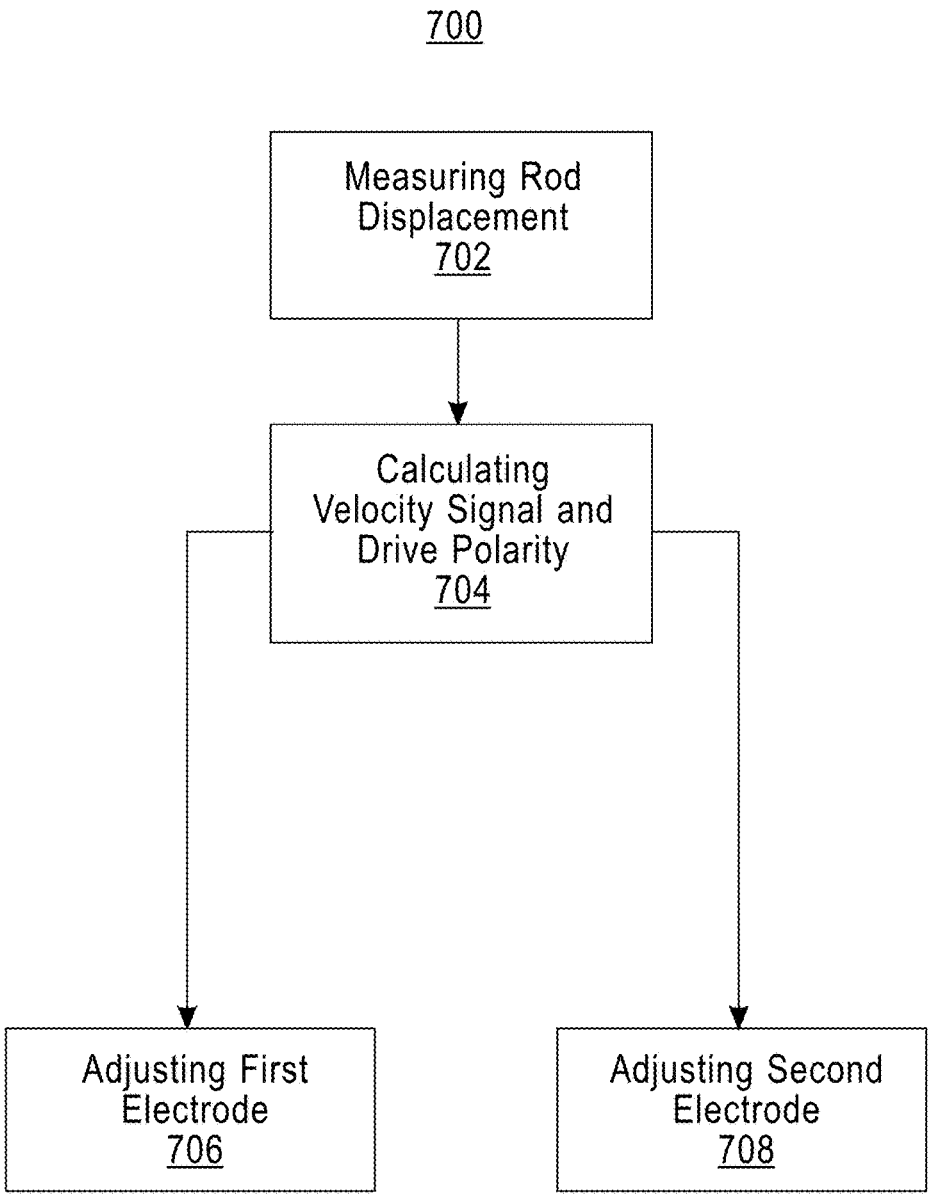
FIG. 7 is a flowchart, designated as 700, depicting operational steps of an alternative method for the parallel dipole line trap, in accordance with an embodiment of the present invention.

FIG. 7 is a flowchart, designated as 700, depicting operational steps of an alternative method for the parallel dipole line trap, in accordance with another embodiment of the present invention.

PID controller 207 is tuned to begin the sequence. In an embodiment, PID controller 207 is tuned in order to ensure the integrity and accuracy of the feedback loop.

Differential photodetectors 205 measure the diamagnetic rod 203 displacement (step 702). In an embodiment, light source 201 transmits a light around diamagnetic rod 203 towards a pair of photodetectors that forms a differential photodetector 205 setup. The difference in the light flux detected by the two photodetectors is proportional to the displacement of the cylindrical rod. The displacement signal is amplified by differential amplifier 208 and then differentiated by a differentiator 209 to produce the velocity signal.

The PID controller 207 processes the velocity signal and produces an output signal to the electrode voltage drive module. In an embodiment, the detected signal, s(t), is amplified by differential amplifier 208, and the signal is fed to the differentiator 209, PID controller 207 and eventually to electrode voltage drive 206. The PID controller 207 feedback system processes any deviation in the velocity signal v(t) of the diamagnetic rod.

Diamagnetic rod 203 is adjusted based on the polarity of the signal from the PID controller. In an embodiment, electrode voltage drive 206 will process the incoming signal to apply a bias drive voltage to either the first electrode 202 or second electrode 211. First electrode 202 will pull the diamagnetic rod 203 towards it when energized with a bias voltage. Second electrode 202 will pull the diamagnetic rod 203 towards it when energized. The bias voltage may be either positive or negative voltage with respect to ground.

If the diamagnetic rod is moving to the right (positive velocity) then the electrode voltage drive 206 will energize the first electrode with a bias voltage to pull the diamagnetic rod 203 towards the left (negative direction) (step 706). If the diamagnetic rod is moving to the left (negative velocity) then electrode voltage drive 206 will energize the second electrode with a bias voltage to pull diamagnetic rod 203 towards the right (positive displacement) (step 708). Furthermore, the differentiator 209 continuously monitors the velocity signal v(t), generated by the system. Based on the velocity signals, PID controller 207 may adjust diamagnetic rod 203 to reach a steady state position or zero velocity. Consequently, if diamagnetic rod 203 reaches a steady state position, then the system reaches the base effective temperature.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a method, and/or a computer program product. The computer program product may include a computer readable storage medium (or media) having computer readable program instructions thereon for causing a processor to carry out aspects of the present invention.

The computer readable storage medium can be any tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, a segment, or a portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. An apparatus for decreasing random motions of a levitated diamagnetic cylinder, the apparatus comprising:

a vacuum chamber;

a plurality of dipole line magnets disposed within the vacuum chamber;

a light source disposed within the vacuum chamber;

one or more photodetectors disposed within the vacuum chamber;

a diamagnetic rod disposed within the vacuum chamber;

a first electrode and a second electrode disposed within the vacuum chamber and connected to an external voltage source;

a control computer comprising a proportional-integral-derivative (PID) control loop;

an input circuit connected to the one or more photodetectors, a differentiator circuit and inputs associated with the PID control loop;

a differentiator circuit to calculate the velocity signal; and an electrode voltage drive circuit connected to the first electrode, the second electrode and with inputs coming from the the PID control loop.

2. The apparatus of claim 1, wherein the first electrode and second electrode are an enclosing electrodes design further comprising two semi-circular cylindrical non-magnetic metal shells partially enclosing the diamagnetic rod.

3. The apparatus of claim 1, wherein the first electrode and second electrode are a non-enclosing electrode design further comprising a plurality of semi-circular cylindrical non-magnetic metal shells facing away from the diamagnetic rod towards the dipole line magnets and separated from the dipole line magnets by an insulator wherein the first electrode and the second electrode share a common electrical ground.

4. The apparatus of claim 1, wherein the first electrode and second electrode are a non-enclosing electrode design further comprising a plurality of semi-circular cylindrical non-magnetic metal shells facing away from the diamagnetic rod towards the dipole line magnets and separated from the dipole line magnets by an insulator wherein the dipole line magnets have a separate electrical ground.

5. The apparatus of claim 1, wherein the first electrode and second electrode are an enclosing electrode design further comprising a plurality of flat rectangular non-magnetic metal sheets adjacent to the diamagnetic rod wherein the dipole line magnets have a separate electrical ground.

6. The apparatus of claim 1, wherein the input circuit further comprises a differential amplifier electrically connected to the differential photodetector pair, differentiator, and control computer.

7. The apparatus of claim 6, wherein the output circuit further comprises an electrode voltage drive electrically connected to the control computer and the first electrode and the second electrode.

8. The apparatus of claim 7, wherein the PID controller loop operates on "the velocity error signal".

9. The apparatus of claim 1, wherein the light source has a broad band spectrum or is monochromatic with wavelength from infrared (IR) to ultra violet (UV).

10. A method for decreasing the effective temperature of a levitated diamagnetic rod trapped between a pair of dipole line magnets, the method comprising:

measuring a displacement signal of a diamagnetic rod based on a light source and one or more photodetectors;

calculating a velocity signal and a drive polarity, based on the displacement signal, by a differentiator circuit wherein the velocity signal is sent to a proportional-integral-derivative (PID) control loop, wherein the PID control loop generates an output signal;

responsive to a positive drive polarity, adjusting a first electrode based on the output signal; and responsive to a negative drive polarity, adjusting a second electrode based on the output signal.

11. The method in claim 10, further comprises:

tuning the PID control loop wherein the PID control loop is connected to an electrode voltage drive, the first electrode, the second electrode, one or more photodetectors, differentiator circuit and an differential amplifier.

12. The method in claim 11, wherein measuring the displacement signal of a diamagnetic rod further comprises:

transmitting a light from a light source towards the one or more photodetectors wherein the diamagnetic rod is disposed between the light source and the one or more photodetectors;

receiving a displacement signal by the differential amplifier associated with the movement of the diamagnetic rod.

13. The method in claim 10, wherein adjusting the second electrode further comprises receiving the output signal from the PDI controller;

applying a voltage to the second electrode based on the output signal; and pulling the diamagnetic rod based on the applied voltage.

14. The method of claim 10, wherein adjusting the first electrode further comprises receiving the output signal from the PID controller;

applying a voltage to the first electrode based on the output signal; and pulling the diamagnetic rod based on the applied voltage.

15. The method in claim 10, further comprising:

monitoring the displacement s(t) and velocity v(t) signal from the control loop.

16. A system for decreasing random motions of a levitated diamagnetic cylinder, the system comprising:

a vacuum chamber;

a plurality of dipole line magnets disposed within the vacuum chamber;

a light source disposed within the vacuum chamber;

one or more photodetectors disposed within the vacuum chamber;

a diamagnetic rod disposed within the vacuum chamber;

a first electrode and a second electrode disposed within the vacuum chamber and connected to an external power source;

a control computer comprising a proportional-integral-derivative (PID) control loop;

an input circuit connected to the one or more photodetectors and inputs associated with the PID control loop;

a differentiator circuit to calculate the velocity signal;

an electrode drive circuit connected to the first electrode, the second electrode and outputs associated with the PID control loop; and a test server connected to the control computer over a network.

17. The system of claim 16, wherein the test server comprises a database wherein the database is used for storing historical changes of the displacement, velocity and effective temperature of the diamagnetic rod.

18. The system of claim 16 wherein PID controller loop operates on "the velocity error signal".

19. The system of claim 16, wherein the network further comprises an Ethernet connection and wireless connection.

20. The system of claim 16, wherein the control computer further comprises of a feed-forward loop and a feedback loop.

* * * * *